United States Patent [19]

Caillaut et al.

[11] Patent Number: 4,761,528

[45] Date of Patent: Aug. 2, 1988

[54] HIGH FREQUENCY INDUCTION MELTING FURNACE

[75] Inventors: Bruno Caillaut, Seyssins; René Perrier de la Bathie, d'Albigny; Jacques Terrier, Sassenage, all of France

[73] Assignee: Commissariat a l'Energie Atomique, Paris, France

[21] Appl. No.: 53,805

[22] Filed: May 26, 1987

[30] Foreign Application Priority Data

Jun. 3, 1986 [FR] France ..... 86 07970

[51] Int. Cl.[4] ..... H05B 6/24

[52] U.S. Cl. ..... 219/10.491; 219/10.75; 219/10.79; 373/154; 373/157

[58] Field of Search ..... 219/10.49 R, 10.75, 219/10.79, 10.67; 373/151–165

[56] References Cited

U.S. PATENT DOCUMENTS

| | | | |
|---|---|---|---|
| 1,975,438 | 10/1934 | Sorrel | 219/10.49 R |
| 3,461,215 | 8/1969 | Reboux | 219/10.49 R |
| 3,601,569 | 8/1971 | Keller | 219/10.79 X |
| 3,980,853 | 9/1976 | Morisaki | 219/10.79 |
| 4,247,736 | 1/1981 | Grigoriev et al. | 219/10.49 R |
| 4,409,451 | 10/1983 | Taylor | 219/10.49 R |
| 4,432,093 | 2/1984 | Reboux | 219/10.49 R |
| 4,610,017 | 9/1986 | Perrier de la Bathie | 373/152 X |

FOREIGN PATENT DOCUMENTS

| | | | |
|---|---|---|---|
| 0079266 | 5/1983 | European Pat. Off. . | |
| 697555 | 10/1940 | Fed. Rep. of Germany . | |
| 3316546 | 4/1984 | Fed. Rep. of Germany . | |
| 1430192 | 1/1966 | France . | |
| 1430962 | 1/1966 | France . | |
| 2540982 | 8/1984 | France . | |
| 54-43343 | 4/1979 | Japan | 219/10.49 R |

*Primary Examiner*—Philip H. Leung
*Attorney, Agent, or Firm*—James E. Nilles

[57] ABSTRACT

An induction furnace for melting refractory materials into a molten state by induction from a high frequency alternating current source. The furnace comprises a material holding crucible formed by a substantially cylindrical side wall having a single cylindrical turn. The side wall terminates in end portions which are spaced apart from each other to define a slot therebetween which extends generally longitudinally of the cylindrical wall. The side wall portions are connected to the source of alternating current so that the side wall turn comprises both the crucible and an inductor. An electrically conductive, elongated cooled member is mounted in the slot in spaced relation between each of the end portions. The elongated member is electrically insulated from the end portions to increase the breakdown voltage between the end portions.

11 Claims, 3 Drawing Sheets

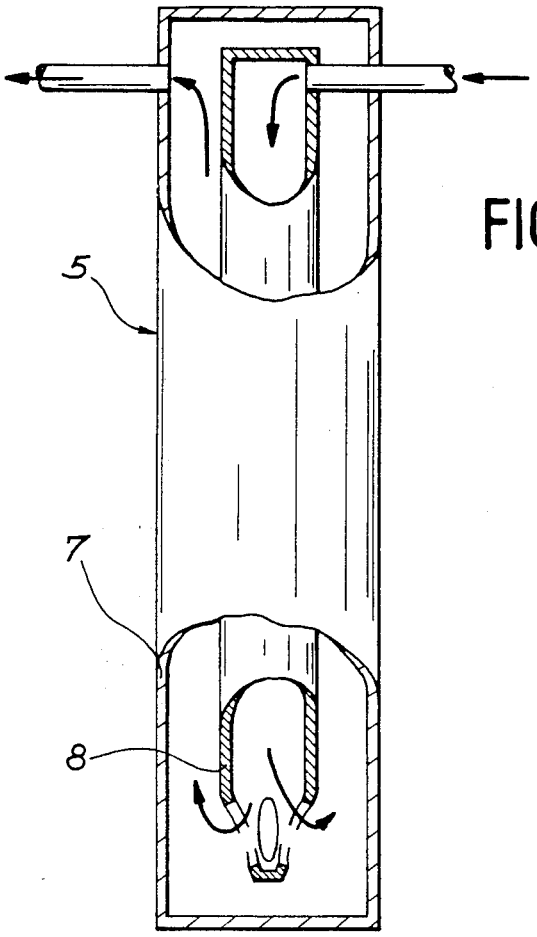
FIG. 2
FIG. 3
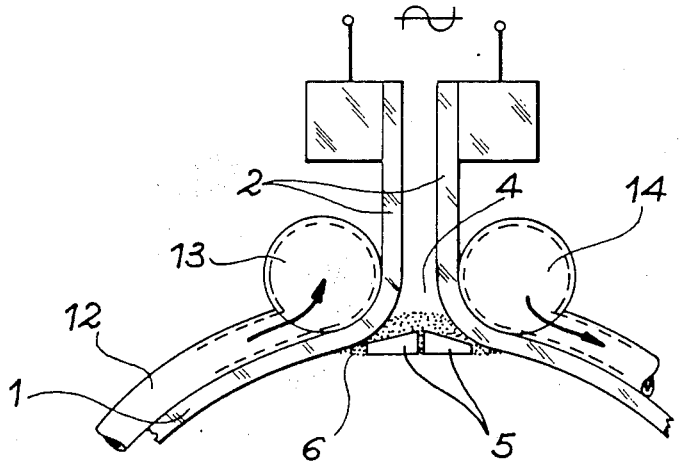

HIGH FREQUENCY INDUCTION MELTING FURNACE

BACKGROUND OF THE INVENTION

The present invention relates to a melting furnace by electromagnetic induction through the circulation of a high frequency alternating current and more particularly usable for the melting and conversion of refractory materials, such as creamic oxides, glass and chemical salts.

The principle of the induction furnace consists of passing an alternating current through an inductor or induction coil. A magnetic field is then formed within said inductor, in which the charge to be liquefied is located. Induced currents are then generated and flow within the charge, being converted into heat energy by the Joule effect, provided that the resistivity of the charge is below a value dependent on the diameter thereof and the frequency in question.

Numerous refractory materials can be looked upon as insulating at ambient temperature, but the resistivity thereof decreases beyond a so-called inductability temperature. It is in this case necessary to provide a heating means for initiating the induction phenomenon. When the charge has been melted, the furnace can operate in continuous casting manner, provided that the appropriate filling and emptying means are available.

Known devices, such as those protected by French Pat. Nos. 1 430 192 and 1 430 962, together with European Pat. No. 0 079 266, reveal that such melting furnaces can have different design variants.

The inductor may be constituted by a simple conductive metal envelope, which is generally cylindrical and is only interrupted by a slot, to whose terminals the voltage taps are applied. Thus, the current performs a complete turn solely around the charge. This design is called monoturn hereinafter.

The inductor may also be constituted by a solenoid (multiturn design), the current then travelling in a helix.

No matter whether it is of monoturn or multiturn form, the inductor can be insulated from the charge to be liquified by a refractory or cooled wall (indirect induction mode). It can also be in contact with the charge to be liquefied and this represents auto-crucible direct induction. The inductor must then be in principle cooled by a fluid circulation; there then being a solid layer of the refractory material, in pulverulent or granular form, which insulates the inductor from the molten charge.

However, these designs suffer from the following disadvantages. The solutions in which an intermediate wall insulates the inductor from the charge have a reduced efficiency as a result of the Joule effect produced in said wall, as well as the electromagnetic decoupling produced.

The auto-crucible solutions require the positioning of an external envelope in the case of a multiturn inductor in order to prevent the flow of the charge out of the crucible. The monoturn inductor suffers from the disadvantage of the risk of an electric arc forming between the two voltage taps of the inductor, particularly if the outer layer of the charge is raised to a temperature above the inductability temperature. This layer is then no longer able to correctly fulfill its electrical insulation function.

Multiturn inductors suffer from the major disadvantage of their high impedance, the inductance being proportional to the square of the number of turns and to the square of the diameter. It is consequently necesary to use small diameter crucibles (in practice no larger than 35 cm for a winding having two turns), which causes induction problems within the charge and also limits the heat exchange surface between the molten bath and the starting material which is continuously added.

Another disadvantage of monoturns is associated with the risk of an electric arc forming between the voltage taps, as stated hereinbefore. Thus, there is a limitation of the potential differences with which it is possible to work.

The present invention leads to an improvement of existing solutions to the extent that it combines the simplest design, namely the monoturn auto-crucible furnace with a device making it possible to avoid risks of arcs, which constitutes the major problem with the monoturn concept.

SUMMARY OF THE INVENTION

The present invention therefore relates to a furnace for melting refractory materials by induction, whose electricity conducting wall is constituted by a single cylindrical turn, whose ends are connected to a high frequency alternating current source, said turn forming both the inductor and the crucible and having cooling means on its surface. The furnace also includes at least one elongated cooled member made from an electricity conducting material arranged along the slot defined by the ends of the turn and which is maintained at a floating potential, being electrically insulated from said turn.

The elongated member constituting the essential means of the invention consequently fulfills a double function. Firstly, due to the fact that it is conductive and is automatically at a potential intermediate between those of the ends of the turn, it substantially eliminates risks of igniting an electric arc between the ends of the turn. Secondly, due to its position along the slot separating the ends of the turn, it permits an adequate cooling to ensure the sealing of the crucible with respect to its content.

According to a supplementary feature, the space between the cooled member and the ends of the turn is filled with an electrical insulating material, which must be able to resist maximum temperatures of approximately 200° C. and which can therefore be made from paper, plaster, epoxy resin or refractory cement in thin layer form.

According to a secondary feature, but which is still important for the present invention and which is preferably applied at the same time as the main feature the bottom of the crucible is made from a conductive material. The turn is then electrically insulated from the bottom of the crucible by a refractory electrical insulant.

According to a realisation of this secondary feature, the conductive material constituting the bottom of the crucible is of the same nature as that of the turn. According to another secondary feature, the bottom of the crucible is made from an insulating material.

According to another secondary feature, the lower part of the turn, adjacent to the bottom of the crucible, is cut or notched. This arrangement, in the case of a conductive crucible bottom, makes it possible according to the invention to not disturb the electromagnetic field in the lower part of the crucible by greatly reducing the coupling between the monoturn and the bottom of the crucible. This arrangement, in the case of an insulating crucible bottom, makes it possible to limit the induction zone in the charge and thus prevents melting on contact with the refractory bottom. To complete this, it is possible to seperate the turn and the bottom by a refractory electrical insulating material and to seal the notches with the aid of the letter.

BRIEF DESCRIPTION OF THE DRAWINGS

Other features and advantages of the invention can be gathered from the following description of a non-limitative embodiment, with reference to the attached drawings, wherein show:

FIG. 2, a front, part sectional view of the member contributing to insulating the voltage taps of the turn of FIG. 1.

FIG. 3, an embodiment of the invention, according to which the electrical insulation of the turn is ensured by two parts arranged in parallel with respect to the member shown in FIG. 2, the arrangement being shown in plan view form.

DETAILED DESCRIPTION OF THE INVENTION

Figure 1:
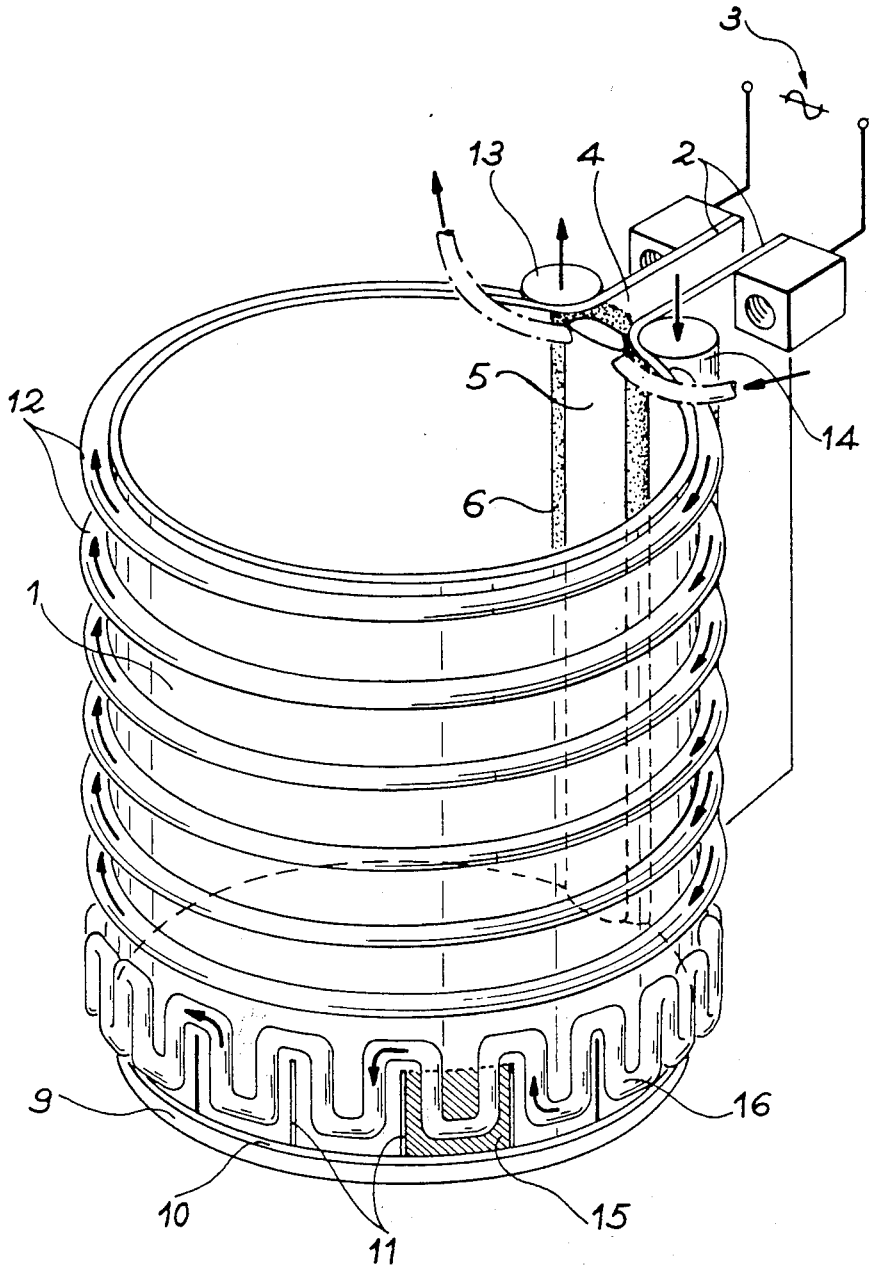
FIG. 1, a general perspective view of the induction furnace according to the invention.

Thus, in FIG. 1, the furnace generally comprises a turn 1 constituted, according to a preferred inventive embodiment, by a curved sheet of an electricity conducting metal, such as copper or aluminium, at the end portions 2 of which is provided an electric circuit 3, which introduces the alternating current necessary for operation.

Along the slot 4 defined by the ends of turn 1 and in the vicinity of the latter is provided at least one elongated member 5 made from an electricity conducting material, which is electrically insulated from turn 1 by a space, which can optionally be filled by an insulating material 6 disposed between member 5 and the ends of turn 1. Because elongated member 5 is electrically conductive but electrically insulated from the cylindrical wall turn, it is inherent that member 5 will be at whatever electrical potential is induced therein by current flowing through the wall turn 1 and thus the potential of member 5 will be referred to hereinafter as a "floating potential".

In the embodiment of the invention described in FIG. 1, there is only one member 5 and it makes it possible to divide by two the voltage value between the two ends of the turn.

In other embodiments of the invention, several members 5 are installed along slot 4 and the voltages between the ends of the turn can be more finely spread. This is more particularly the case with the embodiment to be described relative to FIG. 3.

Each member 5 is subject to the action of the electromagnetic field and is consequently traversed by heat-generating induced currents. It is therefore constituted essentially by a hollow envelope 7, within which flows a cooling fluid. FIG. 2 represents a possible configuration, according to which a metal tube 8 is introduced into envelope 7, whereby the fluid enters by means of said tube 8 and rises along envelope 7.

Insulating material 6, which also serves to seal the crucible, must be able to withstand maximum temperatures of approximately 200° C., because member 5 is cooled. It can be made from paper, plaster, epoxy resin or refractory cement in fine layer form. The crucible bottom 9 can be made from a refractory material, according to an embodiment of the invention.

Figure 4:
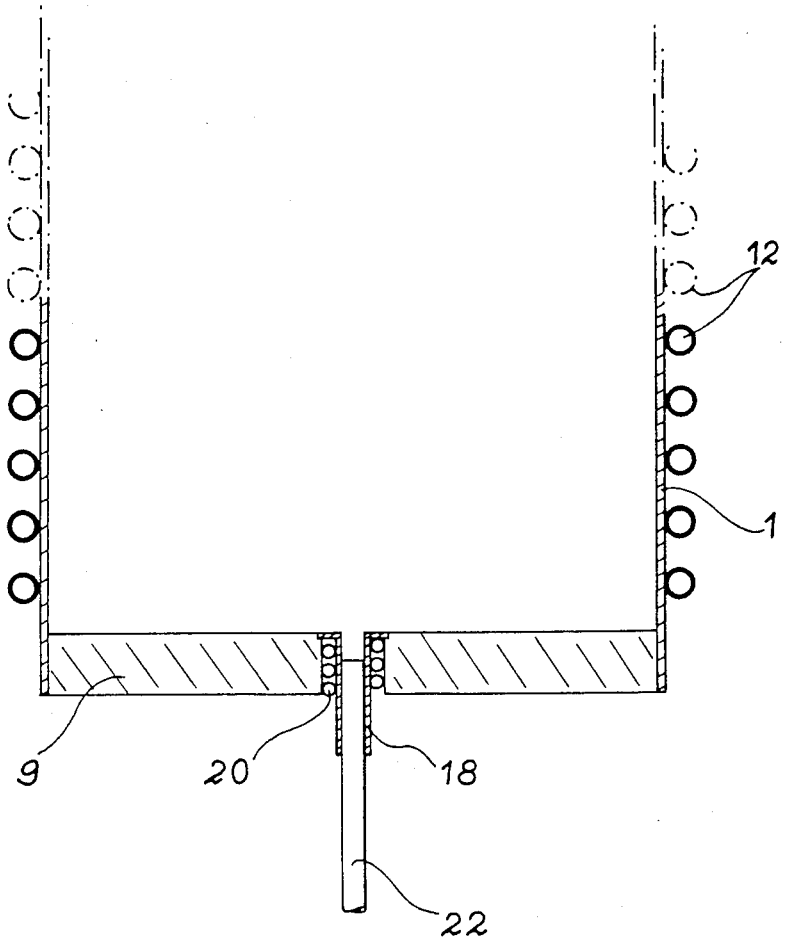
FIG. 4, a section of a non-conductive crucible bottom.

The device shown in FIG. 4 and which is used for emptying the liquefied product is then essentially constituted by a copper tube 18 cooled by several windings of a smaller copper tube 20 in which circulates a cooling fluid, the assembly being embedded in the refractory material forming bottom 9 and sealed by a cooled copper plug 22.

According to another embodiment of the invention, as shown in FIG. 1, bottom 9 can be made from the same conductive material as turn 1, the emptying device then being merely constituted by a hole bored in the bottom and sealed by a cooled copper plug, as for the construction described in the previous paragraph. It is then necessary to ensure the electrical insulation between the bottom and the turn and to prevent an excessive modification of the electromagnetic field lines. For this reason an insulating, refractory joint 10 separates the bottom and the turn and additionally the part of the turn adjacent to the bottom is notched, which eliminates the part of the electromagnetic field which would have undergone coupling due to the presence of the bottom. The notches 11 made in the turn are sealed by an electrical insulating material ensuring the sealing of the crucible. They are generally arranged in periodic form and the length thereof is approximately 1/10 of the height of the turn.

The cooling of the crucible walls is brought about by means of small copper tubes 12, which are the seat of a forced fluid circulation supplied and collected after use by two larger diameter collectors 13 and 14. Tubes 12 are generally circumferential. Only the cutouts 15 limited by the notches are cooled by fluid circulation in the bent tubes 16 running along the cutouts.

This furnace can be adapted to continuous operation, whereby the solid material can be continuously introduced and evacuated in the form of liquid by overflowing with the aid of a not shown drain or spout fixed in the upper part of the turn and as described in French patent application No. 8302328.

The advantage of the invention is that the member or members 5 make it possible to operate with a higher voltage without having to fear the formation of an electric arc between the ends of turn 1. This voltage can be doubled in the case of a furnace only having one such member. It is then possible to work with a turn having a diameter which is twice as large making it possible to treat higher resistivity products, which implies a heat exchange surface which is four times larger.

The inductance and resistance of an inductor and thereof its impedance are proportional to the square of the number of turns. The impedence of a monoturn, which is four times smaller than that of an inductor with two turns, also makes it possible not to change the diameter and to work at a four times lower frequency, which is equivalent from the energy standpoint, but permits the use of alternating current transformation devices which are simpler and more effective in certain cases. These new possibilities can be further extended on inserting several such members 5, as shown with respect to FIG. 3. The latter shows the same essential elements as those described in FIG. 1 and these fulfill the same functions. However, there are two cooled members.

It is possible to work in accordance with the resistivity of the product in the frequency range 40 to 500 kHz by using an aperiodic triode generator, as well as in the range 50 Hz to 40 kHz using a semiconductor generator or the mains.

For example, the material which is melted at approximately 1400° C. is a type VR15F borosilicate glass marketed by HPC. The crude powder is continuously placed on the surface and the melted glass takes place by overflowing using a spout or drain made in the upper part of the inductor.

Table 1 shows the main characteristics and results of the two tests performed with the aid of a monoturn inductor of diameter 400 or 600 mm. For comparison purposes, characteristics and results of a test performed with the aid of an inductor with two turns (diameter 300 mm) according to the prior art are given in the first column of the this table.

TABLE 1

| | 2 turn inductor (diameter 300 mm), prior art | monoturn inductor (diameter 400 mm), prior art | monoturn inductor diameter (600 mm) |
|---|---|---|---|
| frequency kHz | 330 | 310 | 300 |
| HF voltage at inductor terminals (volts) | 830 | 650 | 620 |
| Mains power supplied by generator (kW) | 80 | 65 | 90 |
| Glass production (kg/h) | 50 | 70 | 110 |
| expenditure (kW · h/kg) | 1.5 | 0.9 | 0.8 |

The use of an aperiodic high frequency generator makes it possible to adapt the capacity of the oscillating circuit to the inductor used, so as to give the frequency range indicated by the designer.

What is claimed is:

1. A melting furnace for melting refractory materials into a molten state by induction from a high frequency alternating current source, said furnace comprising:

a material holding crucible which includes a bottom wall and a substantially longitudinally extending, electrically conducting cylindrical side wall having a single cylindrical turn, said side wall turn having end portions spaced apart from each other to define a slot therebetween which extends generally longitudinally of said cylindrical side wall;

means connecting an alternating current source between said side wall turn end portions so that said cylindrical side wall turn constitutes both said crucible and an inductor;

at least one elongated member made from an electrically conducting material mounted in said slot in spaced relation from each of said side wall end portions and electrically insulated from said cylindrical wall, and means for cooling said elongated member.

2. A melting furnace according to claim 1, wherein said space between said elongated member and said end portions of said cylindrical wall is filled with an insulating material.

3. A melting furnace according to claim 1, wherein said bottom wall of said crucible is made from an insulating material.

4. A melting furnace according to claim 1, wherein said bottom wall of said crucible is made from a conductive material.

5. A melting furnace according to claim 4, wherein said conductive material constituting said bottom wall of said crucible is of the same nature as that of said cylindrical wall.

6. A melting furnace according to claim 4, wherein said conductive bottom wall and said cylindrical wall are separated by a refractory electrical insulating material.

7. A melting furnace according to claim 4, wherein said cylindrical wall has a lower part adjacent said bottom wall of said crucible, and wherein only said lower part of said cylindrical wall has a plurality of circumferentially spaced notches therein with adjacent notches defining cutout portions therebetween.

8. A melting furnace according to claim 7, wherein said notches are sealed by a refractory electrical insulating material.

9. A melting furnace according to claim 7, wherein said cutout portions are each cooled by fluid circulating through bent tubes running along said cutout portions.

10. A melting furnace according to claim 9, wherein said bent tubes have a generally serpentine form, and wherein said bent tubes do not cross said notches.

11. A melting furnace according to claim 1, wherein said elongated member comprises a hollow envelope having means which will permit circulation of a cooling fluid therethrough.

* * * * *